United States Patent [19]

Toda

[11] Patent Number: 4,813,047

[45] Date of Patent: Mar. 14, 1989

[54] HIGH FREQUENCY SIGNAL DRIVER FOR A LASER DIODE AND METHOD OF FORMING SAME

[75] Inventor: Minoru Toda, Lawrence Township, Lawrence County, N.J.

[73] Assignee: General Electric Company, Schenectady, N.Y.

[21] Appl. No.: 104,615

[22] Filed: Oct. 5, 1987

[51] Int. Cl.[4] ..... H01P 5/00

[52] U.S. Cl. ..... 372/38; 333/24 R

[58] Field of Search ..... 333/24 R, 35, 33; 372/108, 38; 455/609, 602

[56] References Cited

U.S. PATENT DOCUMENTS

| | | | |
|---|---|---|---|
| 2,249,597 | 7/1941 | Brown | 333/35 |
| 2,526,846 | 10/1950 | Bowman | 333/35 X |
| 3,408,598 | 10/1968 | Beeston, Jr. | 333/33 |
| 4,683,450 | 7/1987 | Max et al. | 333/202 |
| 4,704,630 | 11/1987 | Rodda | 333/206 X |

FOREIGN PATENT DOCUMENTS

| | | | |
|---|---|---|---|
| 163684 | 7/1986 | Japan | 372/38 |
| 303732 | 8/1971 | U.S.S.R. | 333/24 R |

OTHER PUBLICATIONS

P. W. Shumate, Jr. et al., "GaAlAs Laser Transmitter for Lightwave Transmission Systems", Bell Sys. Tech. Jour., vol. 57, pp. 1823–1836, 1978.

W. Albrecht et al., IEEE J. Quantum Electronics, vol. QE-18, pp. 1547–1559.

D. W. Bechtle et al., "An Optical Communications Link in the 2.0–6.0 GHz Band", vol. 43, RCA Review, Jun. 1982, pp. 277–309.

F. E. Terman, Radio Engineering, pp. 105, 848–849, McGraw-Hill, (1947).

*Primary Examiner*—Eugene R. Laroche
*Assistant Examiner*—Benny T. Lee
*Attorney, Agent, or Firm*—Henry I. Steckler; James C. Davis, Jr.; Paul R. Webb, II

[57] ABSTRACT

A signal processing apparatus and method extend the frequency response of a component whose output decreases past a first frequency. The apparatus responds to a signal having a range of frequencies which is applied to a component transmission line and the component transmission line is coupled to the component. The component transmission line is resonant at a second frequency greater than the first frequency and has a source impedance and an input impedance which are not matched. The source impedance is greater than the impedance of the component. The method comprises providing a signal, forming a transmission line which is resonant at the second frequency and coupling the transmission line to both the component and the signal source. The source impedance is adjusted such that the voltage across the component at a low frequency limit is about equal to the voltage across the component at the second frequency.

15 Claims, 2 Drawing Sheets

HIGH FREQUENCY SIGNAL DRIVER FOR A LASER DIODE AND METHOD OF FORMING SAME

The invention relates to an apparatus and method for increasing the frequency response of a component whose output decreases at high frequency.

BACKGROUND OF THE INVENTION

Recent trends in high bit rate communication dictate a need for a signal processing system which can operate from direct current (DC) to microwave frequencies. Unfortunately, many components such as circuits, semiconductor devices and in particular, laser diodes, have an output signal which decreases with increasing frequency. For example, laser diodes are typically modeled as a resistance in parallel with a capacitive impedance. Therefore, as the frequency increases, the capacitive impedance decreases which decreases the component input impedance, thus decreasing the applied voltage and the output signal of the device.

Typically, in order to increase the operating frequency, devices would be designed with reduced capacitance. These devices are then mounted such that the length of the lead wires is minimized to reduce any series inductance. Further, since the resistance of the laser diode is typically about 5 ohm (Ω) a resistor of about 45 Ω would be placed in series with the device. This additional resistance provides an impedance match thereby resulting in a low reflection of a transmitted signal when the device is connected to a coaxial cable having a 50 Ω characteristic impedance. Previously, low reflection and therefore matching has been considered necessary to achieve a flat frequency response from DC to microwave frequencies. Although these efforts have increased the operating frequency of components, it would be desirable to further extend the frequency response of a component whose output decreases at high frequency.

SUMMARY OF THE INVENTION

A signal processing apparatus which extends the frequency response of a component whose output decreases past a first frequency comprises a signal means for producing a signal which is coupled to a component transmission line. The component transmission line is resonant at a frequency, which is greater than the first frequency and has an input impedance which is coupled to a source impedance. The value of the source impedance is different than both the input impedance and the characteristic impedance of the component transmission line. The value of the source impedance is greater than the impedance of the component. The component transmission line is also coupled to the component. The invention also includes a method for extending the flat frequency response of a component whose output decreases past a first frequency. The method comprises forming a transmission line which is resonant at a second frequency greater than the first frequency, providing an input signal from a source, coupling the signal to the transmission line and coupling the transmission line to the component. The value of the source impedance is established to be different than the input impedance such that the voltage across the component, at a low frequency limit, is about equal to the voltage across the component at the second frequency.

It is an object of this invention to increase the frequency response of a component whose output decreases at high frequency.

It is a feature of this invention to have a transmission line which is resonant at a frequency greater than the frequency at which the output of the component begins to decrease.

BRIEF DESCRIPTION OF THE DRAWING

The features of the invention believed to be novel are set forth with particularity in the appended claims. The invention itself, however, both as to organization and method of operation, together with further objects and advantages thereof, may best be understood by reference to the following description taken in conjunction with the accompanying drawing(s) in which:

DETAILED DESCRIPTION OF PREFERRED EMBODIMENTS

Figure 1:
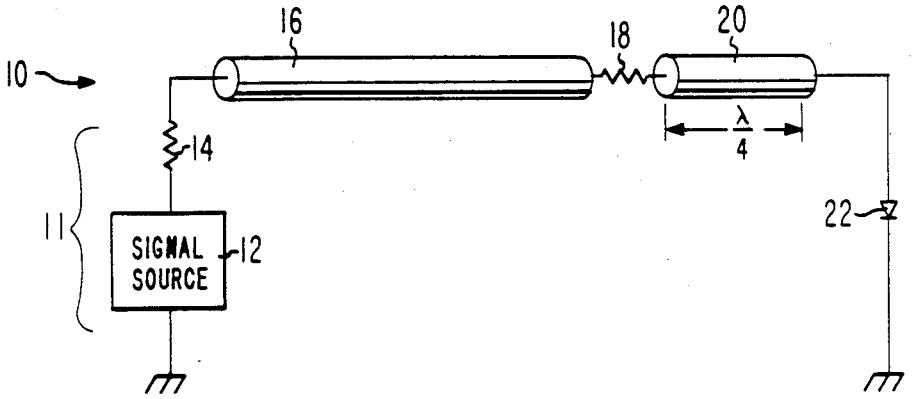
FIG. 1 is a schematic diagram of an embodiment of the invention.

In FIG. 1 a signal processing system 10 comprises signal means 11 for providing a signal and which comprises a signal voltage source 12 and a source matched resistance 14. The source matched resistance 14 is coupled to a source transmission line 16 having a first characteristic impedance $Z_1$. The source transmission line 16 is coupled to a coupling impedance 18 and the coupling impedance 18 is coupled to a component transmission line 20 having a second characteristic impedance $Z_2$. The component transmission line 20 is coupled to a component 22 such as a semiconductor laser diode.

The signal means 11 may comprise the signal voltage source 12 and the source matched impedance 14. The signal voltage source 12 may be any source which provides a signal with a range of frequencies, such as a transistor amplifier to transmit digital or analog signals. The source matched resistance 14 is typically a resistance internal to the signal source and is typically between about 10Ω to 50Ω. Alternatively, the signal means 11 may be a connector or a transmission line which can be coupled to another transmission line which provides the signal.

The source transmission line 16 may be any arbitrary length and is typically a metallized strip line formed on a ceramic plate whose metallization, and thereby the first characteristic impedance $Z_1$, may be altered by standard photolithographic and etching techniques. Preferably, the first characteristic impedance $Z_1$ is about equal to the source matched resistance 14. The source transmission line 16 may also be a coaxial cable. It should be understood that additional transmission lines or connectors may be used between the signal source 12 and the source transmission line 16.

Figure 2:
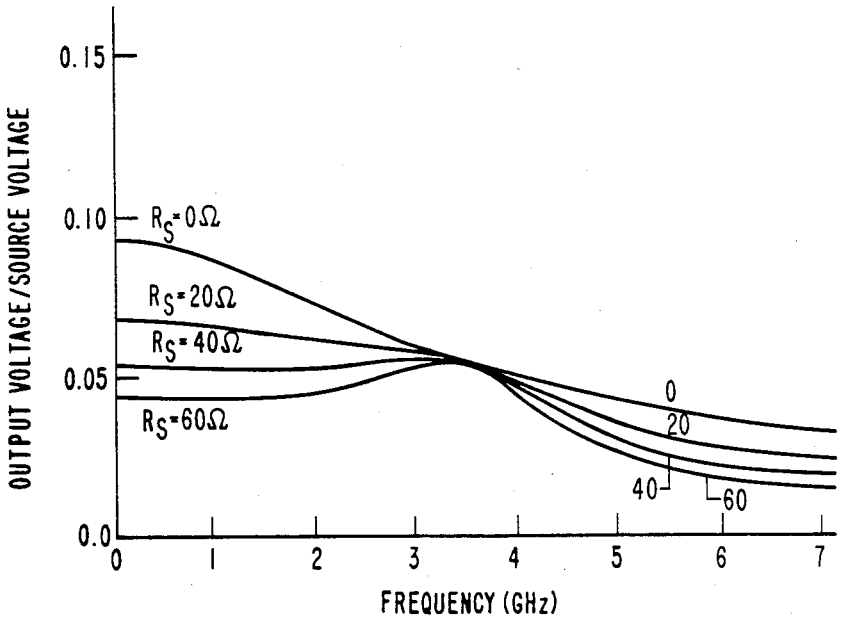
FIG. 2 is an output response curve resulting from the signal processing system of FIG. 1.

The component transmission line 20 is initially resonant at a second frequency which is greater than a first frequency at which the output of the component 22 begins to decrease. For a laser diode, the resonant frequency is typically chosen to be between about 1.5 to 3 times greater than the frequency at which the output voltage is at the −3 decibel (db) level. This resonance typically results from the length of the component transmission line 20 being about equal to one-quarter of the wavelength (λ) in the material. For example, the component transmission line 20 will typically be about 1.45 centimeters (cm) for a chosen resonant frequency of about 3.4 gigahertz (GHz) in a transmission line having a propagation velocity of about $1.95\times10^8$ meters per second (m/sec). A peaking effect in the output occurs when the frequency of the transmitted signal reaches this resonant frequency and the frequency of this peaking may be changed by selecting the length of the transmission line. tHe magnitude of this peaking is determined by the difference between the source impedance of the component transmission line 20 and the second characteristic impedance $Z_2$. When the source impedance of the component transmission line and the second characteristic impedance $Z_2$ are about equal, no peaking will occur. As the difference between these impedances becomes greater, the magnitude of the peak also becomes greater until it reaches its maximum amplitude when the source impedance matches the input impedance of the component transmission line 20. The source impedance is the equivalent impedance from the component transmission line 20 toward the signal means 11 and the coupling impedance increases the source impedance because it is connected in series. When the source matched resistance 14 is matched to the first characteristic impedance $Z_1$, the source impedance of the component transmission line 20 is typically about equal to the value of the first characteristic impedance $Z_1$ in series with the coupling impedance 18. The input impedance is the equivalent impedance of the component transmission line 20 toward the component 22. At the resonant frequency, the input impedance is about equal to the square of the second characteristic impedance $Z_2$ divided by a load impedance. The load impedance is typically about equal to the component 22 impedance, although the connections between the component 22 and the component transmission line 20 may also be determined to form the load impedance by techniques well known in the art. Therefore, when the value of the coupling impedance 18 is changed, the amount of peaking will change. Accordingly, the coupling impedance 18 and the length of the component transmission line 20 are chose, typically by monitoring the voltage of the component, such that the peaking effect at the resonant frequency compensates for the decreasing output of the component 22 at the resonant frequency, thereby obtaining an approximately flat frequency response. A flat frequency response typically varies less than 30% and preferably less than 10%. Alternatively, the coupling impedance 18 may be selected such that the voltage signal to the component 22 at a low frequency limit is about equal to the component 22 signal voltage at the resonant frequency. The low frequency limit being the low frequency output near direct current, such as between 0 and 50 MHz, preferably direct current, in which other components such as capacitors which decrease the output near direct current are not considered. As shown in FIG. 2, a coupling resistance ($R_s$) of about 40Ω results in a flat response to about 3.4 GHz when the source and component transmission lines have a 50 Ω characteristic impedance with a resonant frequency chosen to be about 3.4 GHz and the component transmission line is coupled to a laser diode modeled as a resistance of about 5 Ω in parallel with a capacitance of about 15 picofarad (pf). Additionally, at the resonant frequency which is typically between 1 GHz to 10 GHz, the impedance of the component is small and the source impedance of the component transmission line 20 is typically greater than the impedance of the component 22. Further, the input impedance of the component transmission line 20 will be greater than the source impedance of the component transmission line 20.

It should be understood that the source and input impedance of the component transmission line 20 are not matched as in conventional quarter-wavelength impedance matching. Typically, this impedance matching is considered undesirable when attempting to obtain a flat frequency response from DC to microwave frequencies since a maximum amplitude peak will occur at the resonant frequency thereby making this impedance matching more suitable for narrow bandpass applications. Further, when the component impedance is complex, such as encountered with a resistance in parallel with a capacitance, impedance matching becomes more difficult. Unlike conventional impedance matching having about zero reflection, the source and input impedance of the component transmission line 20 are intentionally mismatched and generally a reflection between about 70% and 80% occurs at the component transmission line 20. The component transmission line is typically a metallized strip line overlying a ceramic plate and the strip line is formed by standard photolithographic and etching techniques.

Figure 3:
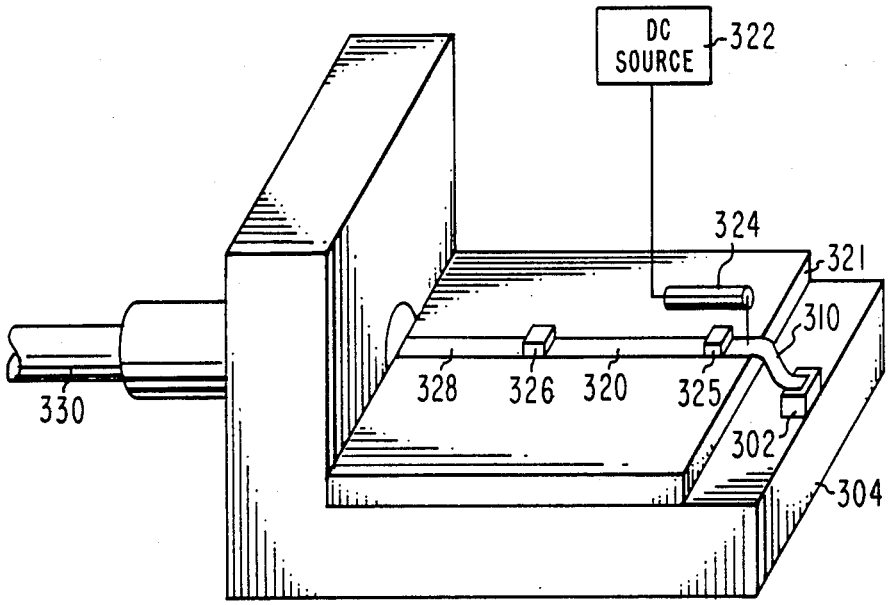
FIG. 3 is a perspective view of a mounted optical signal processing system of the invention.

The component 22 is typically a laser diode which may be modeled as a resistor in parallel with a capacitor. The resistance is typically between about 1 Ω to 10 Ω and the capacitance is typically between about 5 pf to 200 pf. It should be understood that the invention is equally applicable to other components such as circuits or semiconductors including transistors whose output decreases at high frequency. As shown in FIG. 3, a laser 302 is typically mounted such that a first electrical contact is soldered to a header 304 formed of copper. A ribbon wire 310 about 0.5 millimeters (mm) in length connects the component transmission line 320, which is on a ceramic plate 321, to a second electrical contact of the laser 302. A DC source 322 for biasing the laser is coupled to a choke 324, for blocking the DC bias from the signal source, and the choke 324 is connected to the component transmission line 320. A DC blocking capacitor 325 is also positioned on the component transmission line 320. A coupling impedance 326, such as a chip resistor, is mounted on the ceramic plate 321 and is connected to both the component transmission line 320 and a source transmission line 328 formed on the ceramic plate. Preferably, this coupling impedance is located outside the laser 302 package. The signal is delivered to the source transmission line 328 through a coaxial cable 330.

In operation, as depicted in FIG. 1, the signal means 11 provides a signal which may extend between DC and microwave frequencies. This signal passes through the source transmission line 16, through the coupling impedance 18 and through the component transmission line 20 to the component 22. As the signal source increases in frequency, the output of the component 22 decreases as a result of the component's decreasing impedance. This decrease in output is compensated by the peaking effect of the quarter-wavelength component transmission line 20. Therefore, a flat frequency response is obtained even though an impedance mismatch occurs between the component transmission line 20 and the component 22 since the amount of reflection remains approximately constant at all frequencies. It should be understood that since the source matched impedance 14 in FIG. 1 is about equal to the first characteristic impedance $Z_1$, an additional resonant or spurious peaks in the output signal are not formed since all the reflection from the load is absorbed by the source matched resistance 14.

The present invention extends the flat frequency response of a component, such as a laser diode. Further, the phase characteristics of the output are approximately linear, therefore not significantly affecting any digital information transmitted.

While only certain preferred features of the invention have been illustrated and described herein, many modifications and changes will occur to those skilled in the art. It is, therefore, to be understood that the appended claims are intended to cover all such modifications and changes as fall within the true spirit of the invention.

I claim:

1. A signal processing apparatus coupled to a component for applying a voltage across said component, said component having an impedance and whose output decreases when the frequency of an input signal increases past a first frequency, said apparatus comprising:

signal means for providing a signal having a range of frequencies;

a source transmission line having a characteristic impedance and being coupled to said signal means, and a coupling impedance coupled to said source transmission line, said signal means, said source transmission line and said coupling impedance defining a source impedance; and a component transmission line coupled between said coupling impedance and said component, said component transmission line being resonant at a second frequency which is greater than said first frequency, and having a characteristic impedance and an input impedance, said source impedance being different than said input impedance and said characteristic impedance of said component transmission line, and said source impedance being greater than the impedance of said component;

wherein said coupling impedance is of a value such that the voltage across the component at direct current is about equal to the voltage across the component at said second frequency.

2. The apparatus of claim 1 wherein said component comprises a semiconductor laser diode.

3. The apparatus of claim 1 wherein the length of said component transmission line is about equal to one-quarter wavelength of said second frequency.

4. The apparatus of claim 1 wherein said second frequency is between about 1.5 and 3 times greater than the frequency at which the output of said component is at the −3 decibel level with respect to the output of said component at direct current.

5. The apparatus of claim 1 wherein said characteristic impedance of said source transmission line is about equal to said characteristic impedance of said component transmission line.

6. The apparatus of claim 1 wherein said source impedance is about equal to said coupling impedance in series with said characteristic impedance of said source transmission line.

7. The apparatus of claim 1 wherein said signal means comprises a signal source having a source matched impedance.

8. The apparatus of claim 7 wherein the characteristic impedance of said source transmission line is about equal to said source matched impedance.

9. A signal processing apparatus coupled to a component for applying a voltage across said component, said component having an impedance and whose output decreases when the frequency of an input signal increases past a first frequency, said apparatus comprising:

signal means for providing a signal having a range of frequencies, said signal means comprising a signal source having a source matched impedance;

a source transmission line having a characteristic impedance and coupled to said signal source, the characteristic impedance of said source transmission line being about equal to said source matched impedance to define a source impedance; and a component transmission line coupled to said source transmission line and to said component, said component transmission line being resonant at a second frequency which is greater than said first frequency, and having a characteristic impedance and an input impedance, said source impedance being different than said input impedance and said characteristic impedance of said component transmission line, and said source impedance being greater than the impedance of said component.

10. A signal processing apparatus coupled to a component for applying a voltage across said component, said component having an impedance, and whose output decreases when the frequency of an input signal increases past a first frequency comprising:

signal means for providing a signal having a range of frequencies, said signal means defining a source impedance; and a component transmission line coupled to said signal means and to said component, said component transmission line being resonant at a second frequency which is greater than said first frequency, and having a characteristic impedance and an input impedance, said source impedance being different than said input impedance and said characteristic impedance, and said source impedance being greater than the impedance of said component;

wherein said second frequency is between about 1.5 to 3 times greater than the frequency at which the output of said component is at the −3 decibel level with respect to the output of said component at direct current.

11. A method for extending the flat frequency response of a component having an impedance; a voltage thereacross, and whose output signal amplitude decreases as frequency of the output signal increases past a first frequency, said method comprising the steps of:

providing an input signal from a source having a source impedance;

forming a component transmission line having a component transmission input impedance, said component transmission line being resonant at a second frequency which is greater than said first frequency with a difference between the source impedance and said input impedance of said component transmission line such that the voltage across the component at a selected low frequency limit is about equal to the voltage across the component at said second frequency;

coupling said input signal to the component transmission line;

coupling said component transmission line to the component; and wherein the step of forming a component transmission line further comprises the steps of:

selecting said second frequency to be between about 1.5 to 3 times greater than the frequency at which the output of said component is at the −3 decibel level with respect to the output of said component at direct current; and fabricating a transmission line having a length about one-quarter wavelength at said second frequency.

12. The method of claim 11 wherein the forming step comprises selecting the source impedance such that the output signal of the component is about flat in amplitude between direct current and said second frequency.

13. The method of claim 12 wherein said output signal varies less than 30% in amplitude between DC and said second frequency.

14. The method of claim 12 wherein said output signal varies less than 10% in amplitude between DC and said second frequency.

15. The method of claim 14 wherein the difference between said source impedance and said input impedance of said component transmission line is sufficient to achieve a reflection between about 70% and 80% at said component transmission line.

* * * * *